United States Patent [19]

Kalra

[11] Patent Number: 4,972,169

[45] Date of Patent: Nov. 20, 1990

[54] SPIRAL WOUND SAND FUSE

[75] Inventor: Varinder K. Kalra, St. Louis, Mo.

[73] Assignee: Cooper Industries, Inc., Houston, Tex.

[21] Appl. No.: 384,562

[22] Filed: Jul. 24, 1989

Related U.S. Application Data

[63] Continuation-in-part of Ser. No. 204,841, Jun. 9, 1988, abandoned.

[51] Int. Cl.[5] ..... H01H 85/04

[52] U.S. Cl. ..... 337/163; 337/158; 337/166

[58] Field of Search ..... 337/161, 162, 163, 164, 337/165, 166, 158

[56] References Cited

U.S. PATENT DOCUMENTS

| | | | |
|---|---|---|---|
| 4,445,106 | 4/1984 | Shah | 337/163 |
| 4,703,300 | 10/1987 | Gaia | 337/163 |
| 4,736,180 | 4/1988 | Oh | 337/163 |

*Primary Examiner*—H. Broome
*Attorney, Agent, or Firm*—Donald J. Verplancken; David A. Rose; Ned L. Conley

[57] ABSTRACT

A spiral wound sand fuse has a non-reactive fiber core permitting use of the fuse to interrupt high fault currents in high voltage circuits.

9 Claims, 2 Drawing Sheets

SPIRAL WOUND SAND FUSE

RELATED APPLICATIONS

This is a continuation-in-part of U.S. patent application Ser. No. 07/204,841, filed Jun. 9, 1988 (now abn).

BACKGROUND OF THE INVENTION

This invention relates to the field of electric circuit protection devices, more particularly to the field of circuit interruption devices, and more particularly still to fusing devices.

Electrically powered devices ranging from industrial motors to television sets, employ fuses to protect their internal circuitry from electric short circuit or overload conditions. The fuse element is typically constructed by connecting a fuse wire between conductive end caps disposed on the ends of an insulative tube. The end caps include a solder coating along their inner surface, to which the ends of the fuse wire are integrally connected. In some cases, the fuse wire may extend through a hole in the end cap and be soldered to the outer surface thereof. Thus, the fuse wire is placed in the tube and is in electrical conductive engagement with the end caps. The fuse is placed in the circuit to be protected such that the fuse link melts when an abnormal overload condition occurs, and the conduction of electricity through that particular circuit should cease.

Devices such as television sets and electric motors must typically carry a surge current, or short term current overload, when starting. This surge current is a function of the electric device, and not the power supply circuit. The surge current state continues until the equipment circuitry reaches an electrical steady state condition, which can take several seconds. The fuse cannot distinguish this condition from a source related overload condition, and will therefore open unless some allowance is made to permit this short term overload to pass through the fuse without melting the fuse wire. To ensure future protection of the equipment, this allowance must not adversely affect the future performance of the fuse. Fuses having the characteristics to perform this duty are known as time lag fuses. One such type of time lag fuse is the spiral wound fuse.

A spiral wound fuse has a tubular insulating body with conductive end caps disposed on each end thereof, and a fuse link assembly soldered to the inner surface of each end cap. It is also known to extend the fuse wire through an opening in the end cap and place the solder connection on the outer surface thereof. The fuse wire assembly includes a core of twisted yarn fibers which are devoid of sizing, and a fuse wire wound around the core in a spiral pattern. The yarn is typically a ceramic material, which is fired in a furnace to remove the sizing placed on the fibers during the manufacturing process. The core-fuse wire combination forms a semi-rigid fuse link assembly which maintains its position when soldered in place inside the tubular body. The use of a plating material such as tin permits the use of a larger cross section fuse wire than would be permissible if it were uncoated. When a circuit overload is encountered, the passage of the excess current through the fuse wire causes the fuse wire to generate heat and thereby elevate the fuse wire temperature. The core acts as a heat sink to draw this heat away from the fuse wire, thereby lowering the fuse wire temperature. The transfer of heat from the fuse wire to the core lengthens the time required before the fuse wire melting temperature is reached, thereby creating a time lag fuse.

To help ensure continued fuse effectiveness for repeated surge current cycles, the fuse wire is constructed of a base metal with its outer surface being plated with another metal such as tin. Under short term surge conditions, the base metal and plated layer remain metallurgically distinct. However, if an overload condition persists, the tin plating material will migrate into the base metal, forming an alloy having a lower melting temperature than the base metal. The longer the duration of the overload, the more migration and attendant alloying which occurs. Ultimately, due to the heat produced by the overload the melting temperature of the alloying fuse wire will be reached, thereby causing the fuse wire to melt and open the fuse. The size of the wire, type of plating material and base metal, and amount of plating may all be modified to change the alloying characteristics of the fuse thereby ensuring that the alloying does not occur until the overload condition persists beyond the expected surge current duration. An example of this type of fuse is depicted in U.S. Pat. No. 4,445,106.

One problem commonly encountered with this type of fuse in the presence of arc quenching fillers is the tendency for the fuse wire and core to metallurgically interact when the fuse opens, leaving a carbon deposit adjacent the fuse wire-core interface. This carbon deposit is electrically conductive, which permits a leakage current to flow through the fuse after the fuse link severs to open the fuse.

The use of a core material has been known for at least fifty years. U.S. Pat. No. 2,157,906, Lohausen, discloses a fuse having a ceramic core. The core appears to be a solid extruded section of ceramic, rather than a twisted bundle of individual fibers.

It is known in the fuse art that the use of silicates packed around the fuse element will help reduce arcing which may occur during fuse opening under short circuit conditions. U.S. Pat. No. 2,007,313, Sherwood, discloses a cartridge fuse having magnesium oxide fillers. These fillers are commonly used to extinguish arcing which occurs at high voltage-high amperage interruptions, which tend to produce significant amounts of heat at a very high rate of generation. It is known that the combination of a heat sink core and silicate fillers to create a time lag fuse with high voltage-high amperage interruption capabilities is impractical because the tin plating on the wire will react with the ceramic core at the temperatures reached during arcing thereby leaving a conductive coating on the core, although the fusing link has severed or partially evaporated. This conductive residue permits continued current flow through the fuse which is unacceptable. Therefore, spiral wound fuses have been limited to low current-low voltage applications where significant arcing is not expected.

SUMMARY OF THE INVENTION

The present invention is a spiral wound sand fuse having a tin plated fusing element spirally wound on a fiber glass spun fiber core supported between and soldered to opposed conductive end caps on the ends of a tubular insulative sleeve body. The fiber glass core is manufactured from a non-reactive fiber glass which eliminates the carbon deposition problem present with the ceramic core of Shah if placed in the presence of arc quenching fillers. The fuse of the present invention has both arc quenching and time lag fusing characteristics.

One object of the invention is to provide a fuse having both time lag and arc quenching features for high voltage and high current applications.

BRIEF DESCRIPTION OF THE DRAWINGS

The above and other objects and advantages of the present invention will become apparent from the following description when read in conjunction with the following drawings, wherein.

BRIEF DESCRIPTION OF THE PREFERRED EMBODIMENT

Figure 1:
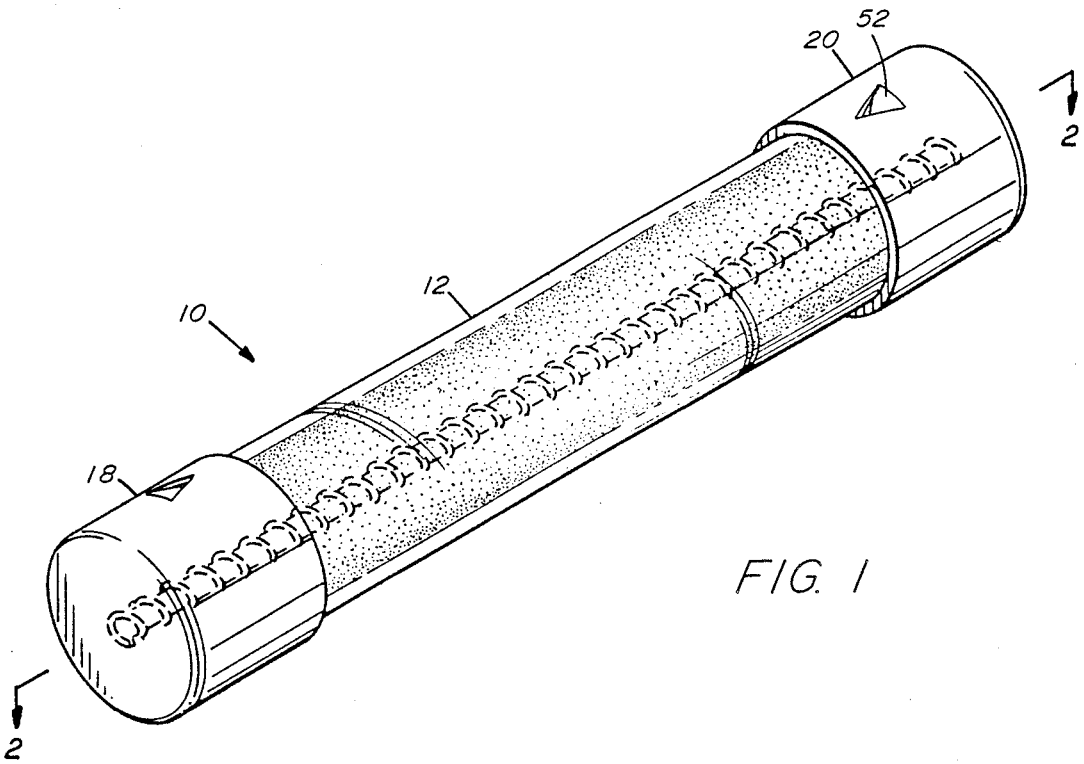
FIG. 1 is a perspective view of a spiral wound fuse according to the present invention.
Figure 2:
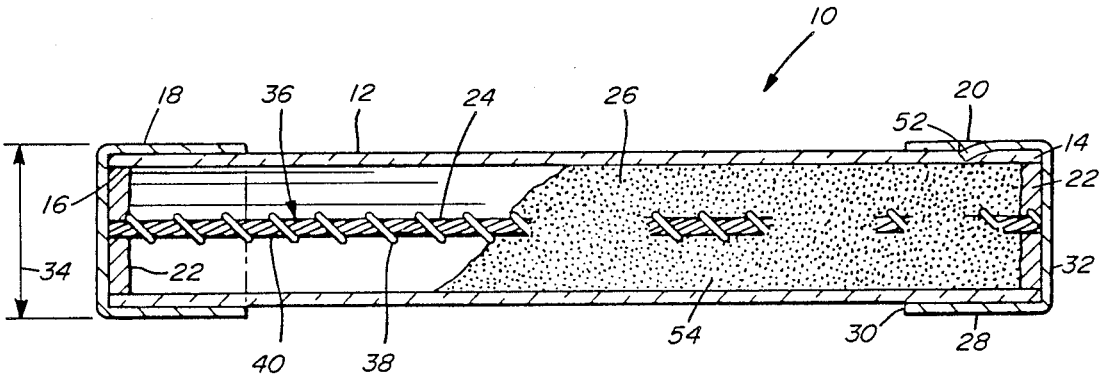
FIG. 2 is a longitudinal partial section view through the fuse at section 2—2 of FIG 1; and, FIG. 3 is a cross sectional view of the fusing link.
Figure 3:
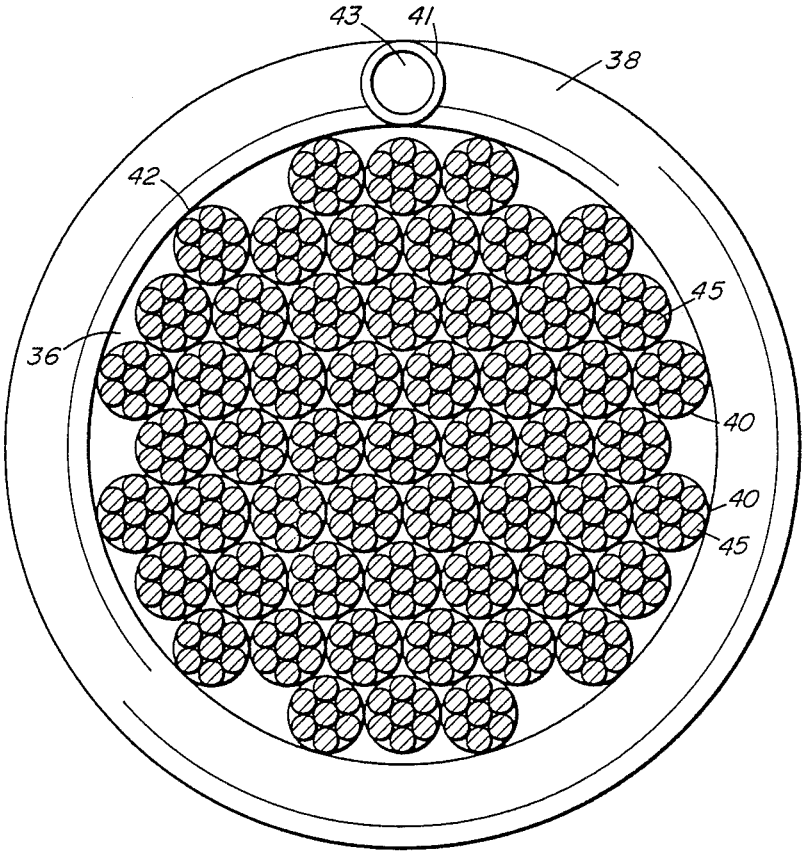

Referring to FIGS. 1, 2 and 3, fuse 10 includes an annular cylindrical body portion 12 having opposed open ends 14, 16. A pair of conductive end caps 18, 20 having a solder coating 22 therein are disposed on opposed ends 14, 16. A fusing link assembly 24 is disposed through body 12 and retained in solder 22 on end caps 18, 20. Silicates 26 are packed around fusing link assembly 24 within body 12.

Body portion 12 is a right annular tubular segment of insulative material preferably cut from a length of extruded tubular stock. End caps 18, 20 are preferably constructed from a conductive metal such as copper or one of its alloys, and may be plated with tin or other conductive coatings. Each end cap 18, 20 has a tubular wall portion 28 terminating in an open body receiving end 30 and a generally flat enclosure end 32. Enclosure end 32 is a generally circular portion which is a continuation of tubular wall 28. The inner perimeter of end caps 18, 20 ihncludes a tubular diameter 34 which is sized to cause tubular portion 28 to engage the outer perimeter of body 12 to retain end caps 18, 20 thereon. Solder 22, in the form of a coating, is disposed on the inner surface of the enclosure end 32. Each end cap 18, 20 is preferably extruded from a single piece of sheet stock.

Referring to FIG. 3, Fusing link assembly 24 includes a core 36 of a nonreactive material, preferably woven fiber glass and a fusing link 38, preferably a wire having tin plating 41 thereon on a copper or brass base wire 43. Core 36 includes a plurality of fiberglass strands 40 woven together, or spun, on a yarn making machine, to create a length of woven fiber glass core yarn 42. Each strand 40 is comprised of multiple fibers 45 woven together to form strand 40. The woven fiberglass core yarn 42 is fired in a furnace to volatilize any sizing or other binder material placed on the yarn by the manufacturer. This is preferably accomplished by placing the woven fiber glass core yarn in a furnace at 550 degrees Centigrade. The duration of this firing ranges from 6 to 12 hours. The length of core yarn 42 forming core 36 is then wrapped with a length of tin plated fusing link 38, and individual segments of this subassembly are cut off to form fusing link assemblies 24. The core yarn 42 forming core 36 is sufficiently flexible to permit wrapping of the fusing wire 38 thereon in an automated process.

Woven fiber glass core yarn 42 must be nonreactive to tin or other plating materials in the fuse environment. It has been found that type "s" fiberglass nmanufactured by Owens Corning and twisted into yarn by Jonathan Temple And Co., Inc., when fired to drive off any sizing, is nonreactive to the plating on the fusing link 38. It is believed that this material is chemically inert to tin even in the presence of arc-quenching fillers, which results in a fuse which does not have a carbon or other composition conductive deposit remaining on the core 36 after the fusing wire 38 opens. The prior art fuses, which employ ceramic yarn cores, would react in the presence of fillers with tin plated fuse wires during the fuse opening cycle to create a conductive film on the core. This reaction would lead to post opening fuse leakage currents through the fuse.

Referring now to FIGS. 1 and 2, the fuse 10 is assembled by taking a section of tubular body 12 cut to the proper length, and placing an end cap 18 having a solder coating 22 therein on body end 16. The end cap 18 is retained on body 12 by means of flux, adhesive or other mechanical means. A fusing link assembly 24 is then dropped into the open end 14 of body 12, and the end cap 18 is heated to create a solder joint between fusing wire 38 and solder 22. Arc quenching silicates 54 are then packed into the cavity within body 12 around fusing link assembly 24. End cap 20 is the placed over end 14, and the assembly is heated to reflow the solder and create a conductive solder joint between the fusing wire 38 and solder 22. Crimps 52 are then placed on the outer surface of end caps 18, 20 and into body 12 to retain end caps 18, 20 thereon.

The spiral wound sand fuse of the present invention has been tested to successfully interrupt current of 10,000 amperes at 500 volts. It is believed that the present design is capable of interrupting larger current values at even 600 volts. The nonreactive nature of the type "s" fiber glass core 36 and tin plated fusing link 38 in the presence of fillers allows for the use of the fuse at fault currents of several thousand amperes in high voltage circuits where ceramic fiber core spiral wound fuses are unusable because of the reactivity of the core and tin plated wire.

I claim:

1. A fuse, comprising;
   - a tubular insulative body;
   - end caps disposed on the ends of said tubular body having a solder coating thereon;
   - a fusing link assembly disposed within said tubular body and in conductive engagement with said solder coatings;
   - said fusing link assembly having a non-reactive core in the presence of an arc quenching material and a plated fuse wire spirally disposed thereon; and,
   - arc quenching silicates disposed about said fusing link assembly within said tubular body.

2. The fuse of claim 1 wherein said fuse wire is tin plated.

3. The fuse of claim 1 wherein said core is type "s" fiberglass.

4. A time lag fuse for high voltage-high amperage fault currents, comprising:
   - a length of fiberglass yarn;
   - a wire spirally wound around said length of fiberglass yarn;
   - said wire and fiberglass yarn being packed in silicates and forming a portion of the circuit for the high amperage fault current;
   - said wire, fiberglass yarn and said silicates being nonreactive during the fault current interruption.

5. The fuse of claim 4 wherein said wire is plated with a metal which is chemically inert with said fiberglass yarn.

6. The fuse of claim 4 wherein said yarn is heat treated to volatilize any binder material on said yarn.

7. A fuse, comprising:

a tubular insulative body;

end caps disposed on the ends of said tubular body having a solder coating thereon;

a core of a plurality of woven strands of fiberglass extending between said end caps, said core being devoid of any sizing and binding material for the fiberglass;

a base metal wire plated with tin, said base metal wire being spirally wrapped around said core and in conductive engagement with said solder coatings;

arc quenching silicates disposed about said core and base metal wire within said tubular insulative body; and said fiberglass being chemically inert to tin in the presence of said arc quenching silicates whereby said core and tin plated base metal wire do not metallurgically interact when the fuse opens to leave an undesirable conductive deposit of carbon.

8. The fuse of claim 7 wherein said fiberglass is type "s" fiberglass.

9. The fuse of claim 7 wherein said core is heat treated to volatilize any sizing and binding material on said fiberglass.

* * * * *